US007607962B2

(12) United States Patent
Hardin

(10) Patent No.: US 7,607,962 B2
(45) Date of Patent: Oct. 27, 2009

(54) ELECTRONIC TOY WITH ALTERABLE FEATURES

(75) Inventor: Mark Hardin, Hermosa Beach, CA (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 11/743,274

(22) Filed: May 2, 2007

(65) Prior Publication Data

US 2008/0026672 A1 Jan. 31, 2008

Related U.S. Application Data

(60) Provisional application No. 60/798,009, filed on May 4, 2006.

(51) Int. Cl.
*A63H 29/22* (2006.01)

(52) U.S. Cl. ..... 446/484; 446/321; 446/175

(58) Field of Classification Search ..... 446/175, 446/484, 168–169, 173, 82, 477; 463/1; 434/402–403, 428
See application file for complete search history.

(56) References Cited

U.S. PATENT DOCUMENTS

| | | | |
|---|---|---|---|
| 1,199,413 | A | 9/1916 | Peyser |
| 1,614,923 | A | 1/1927 | Honti |
| 1,661,429 | A | 3/1928 | Jade |
| 1,966,986 | A | 7/1934 | Martin |
| 2,155,193 | A | 4/1939 | Johntz |
| 2,749,657 | A | 6/1956 | Lohnes |
| 2,872,753 | A | 2/1959 | Fenton |
| 3,049,814 | A | 4/1962 | McLain |
| 3,768,175 | A | 10/1973 | Hill et al. |
| 4,026,066 | A | 5/1977 | Reiner et al. |
| 4,195,437 | A | 4/1980 | Ace |
| 4,313,270 | A | 2/1982 | Volkert et al. |
| 4,342,173 | A | 8/1982 | Otake |
| 4,398,723 | A | 8/1983 | Erickson et al. |
| 4,421,317 | A | 12/1983 | Hector et al. |
| 4,424,967 | A | 1/1984 | Yokoi et al. |
| 4,467,556 | A | 8/1984 | Iwao et al. |
| 4,477,999 | A | 10/1984 | Harigai et al. |
| 4,508,519 | A | 4/1985 | Becker |
| 4,516,948 | A | 5/1985 | Obara |
| 4,575,348 | A | 3/1986 | Wiggs et al. |
| 4,599,078 | A | 7/1986 | Obara |
| 4,623,317 | A | 11/1986 | Nagano |

(Continued)

FOREIGN PATENT DOCUMENTS

| | | |
|---|---|---|
| CA | 491235 | 3/1953 |

(Continued)

*Primary Examiner*—Dmitry Suhol
*Assistant Examiner*—Alex F. R. P. Rada, II
(74) *Attorney, Agent, or Firm*—Kolisch Hartwell, P.C.

(57) ABSTRACT

An electronic toy with alterable features. The toy includes a body having a sensor adapted to detect at least a first orientation of the body and a second orientation of the body, and provide a corresponding sensor output. In some embodiments, the toy includes a controller configured to select a set of toy outputs from a library of toy outputs in response to the sensor output. The toy outputs may include a play mode and/or a persona. In some embodiments, the toy includes one or more movable portions coupled to the body and adapted to move in response to changes in the orientation of the body.

21 Claims, 3 Drawing Sheets

U.S. PATENT DOCUMENTS

| | | | | |
|---|---|---|---|---|
| 4,668,205 | A | 5/1987 | Choy et al. | |
| 4,680,018 | A | 7/1987 | Ohno | |
| 4,680,022 | A | 7/1987 | Hoshino et al. | |
| 4,750,895 | A | 6/1988 | Shinohara et al. | |
| 4,755,159 | A | 7/1988 | Templeton et al. | |
| 4,762,511 | A | 8/1988 | Lee et al. | |
| 4,833,802 | A | 5/1989 | Volkert | |
| 4,865,574 | A | 9/1989 | Kobayashi | |
| 4,867,723 | A | 9/1989 | Asbach | |
| 4,969,851 | A | 11/1990 | Rasmussen | |
| 5,004,445 | A | 4/1991 | Coleman et al. | |
| 5,019,010 | A | 5/1991 | Nikaido et al. | |
| 5,069,650 | A | 12/1991 | Lehmann et al. | |
| 5,150,899 | A | 9/1992 | Kitaue | |
| 5,183,427 | A | 2/1993 | Draper | |
| 5,228,225 | A | 7/1993 | Lee | |
| 5,310,378 | A | 5/1994 | Shannon | |
| 5,329,714 | A | 7/1994 | Lee | |
| 5,435,769 | A | 7/1995 | Bertrand | |
| 5,451,055 | A | 9/1995 | Lo | |
| 5,562,520 | A | 10/1996 | Pridonoff et al. | |
| 5,580,296 | A | 12/1996 | Chow | |
| 5,682,999 | A | 11/1997 | Larson | |
| 5,831,590 | A | 11/1998 | Ikedo | |
| 5,966,137 | A | 10/1999 | Murata | |
| 5,966,526 | A | 10/1999 | Yokoi | |
| 5,971,833 | A | 10/1999 | Rasmussen et al. | |
| 6,048,251 | A | 4/2000 | Klitsner et al. | |
| 6,056,618 | A | 5/2000 | Larian | |
| 6,155,565 | A | 12/2000 | Gomez et al. | |
| 6,165,068 | A | 12/2000 | Sonoda et al. | |
| 6,213,871 | B1 | 4/2001 | Yokoi | |
| 6,227,966 | B1 | 5/2001 | Yokoi | |
| 6,273,815 | B1 | 8/2001 | Stuckman et al. | |
| 6,394,903 | B1 * | 5/2002 | Lam | 463/22 |
| 6,449,518 | B1 | 9/2002 | Yokoo et al. | |
| 6,461,238 | B1 | 10/2002 | Rehkemper et al. | |
| 6,493,001 | B1 | 12/2002 | Takagi et al. | |
| 6,500,070 | B1 | 12/2002 | Tomizawa et al. | |
| 6,537,149 | B2 | 3/2003 | Sogabe | |
| 6,540,606 | B1 | 4/2003 | Matsukata | |
| 6,609,968 | B1 | 8/2003 | Okada et al. | |
| 6,652,383 | B1 | 11/2003 | Sonoda et al. | |
| 6,656,049 | B1 | 12/2003 | Masaki et al. | |
| 6,722,973 | B2 | 4/2004 | Akaishi | |
| 6,832,955 | B2 | 12/2004 | Yokoi | |
| 6,901,379 | B1 | 5/2005 | Balter et al. | |
| 6,937,152 | B2 * | 8/2005 | Small | 340/568.1 |
| 6,939,231 | B2 | 9/2005 | Mantyjarvi et al. | |
| 2001/0034668 | A1 | 10/2001 | Whitworth | |
| 2001/0042029 | A1 | 11/2001 | Galvez | |
| 2002/0022506 | A1 | 2/2002 | Rifkin | |
| 2002/0082079 | A1 | 6/2002 | Mantyjarvi | |
| 2003/0012454 | A1 | 1/2003 | Manico | |
| 2003/0107585 | A1 | 6/2003 | Samuelson | |
| 2003/0160588 | A1 * | 8/2003 | Kroll | 320/103 |
| 2004/0095326 | A1 | 5/2004 | Anderson | |
| 2004/0133354 | A1 | 7/2004 | Low | |
| 2004/0250210 | A1 | 12/2004 | Huang | |
| 2005/0119037 | A1 | 6/2005 | Yokoi | |
| 2005/0137015 | A1 | 6/2005 | Rogers | |
| 2005/0182693 | A1 | 8/2005 | Alivandi | |
| 2005/0233675 | A1 | 10/2005 | Marine | |
| 2005/0245302 | A1 | 11/2005 | Bathiche | |
| 2006/0154711 | A1 | 7/2006 | Ellis | |
| 2006/0160588 | A1 * | 7/2006 | Yamada et al. | 463/1 |
| 2006/0172787 | A1 | 8/2006 | Ellis | |

FOREIGN PATENT DOCUMENTS

| | | |
|---|---|---|
| EP | 000390828-0001 | 8/2005 |
| EP | 000390828-0002 | 8/2005 |
| EP | 000390828-0003 | 8/2005 |
| EP | 1640921 | 3/2006 |
| GB | 154722 | 12/1920 |
| GB | 2135590 | 9/1984 |
| GB | 2135591 | 9/1984 |
| GB | 2159721 | 12/1985 |
| GB | 2184663 | 7/1987 |

* cited by examiner

ELECTRONIC TOY WITH ALTERABLE FEATURES

CROSS-REFERENCE TO RELATED APPLICATIONS

This application claims priority under 35 U.S.C. 119(e) to U.S. Provisional Patent Application No. 60/798,009 entitled "Flip-Over Playsets With Animated Electronic Virtual Creatures," filed May 4, 2006, the disclosure of which is incorporated herein by reference.

BACKGROUND

Some toys allow a child to alter the toy by changing the toy's orientation, such as by flipping the toy upside-down. Some of these toys include switches that sense the change in orientation and change the sound or light emitted by the toy. Some of these toys include items that slide or pivot as the orientation of the toy is changed. However, changes in the toy's features are limited to changes in the toy's physical features.

Games and toys incorporating electronic displays or changes in toy features are found in U.S. Pat. Nos. 4,424,967, 5,150,899, 5,831,590, 5,966,137, 6,449,518, 6,493,001, and 6,901,379; U.S. Published Patent Application Nos. 2001/0034668, 2001/0042029, 2002/0022506, 2002/0082079, 2003/0012454, 2003/0107585, 2004/0250210, 2005/0137015, 2005/0182693, 2005/0233675, 2006/0154711 and 2006/0172787; and European Community Design Registration Nos. 000390828-0001-0003, the disclosures of which are incorporated herein by reference.

SUMMARY

The present disclosure relates generally to a toy having alterable features. More specifically, it relates to a toy in which the device may alter the toy features, such as a play mode and/or persona, based on the orientation of the device.

The advantages of the disclosed toy may be understood more readily after a consideration of the drawings and the Detailed Description.

DETAILED DESCRIPTION

Figure 1:
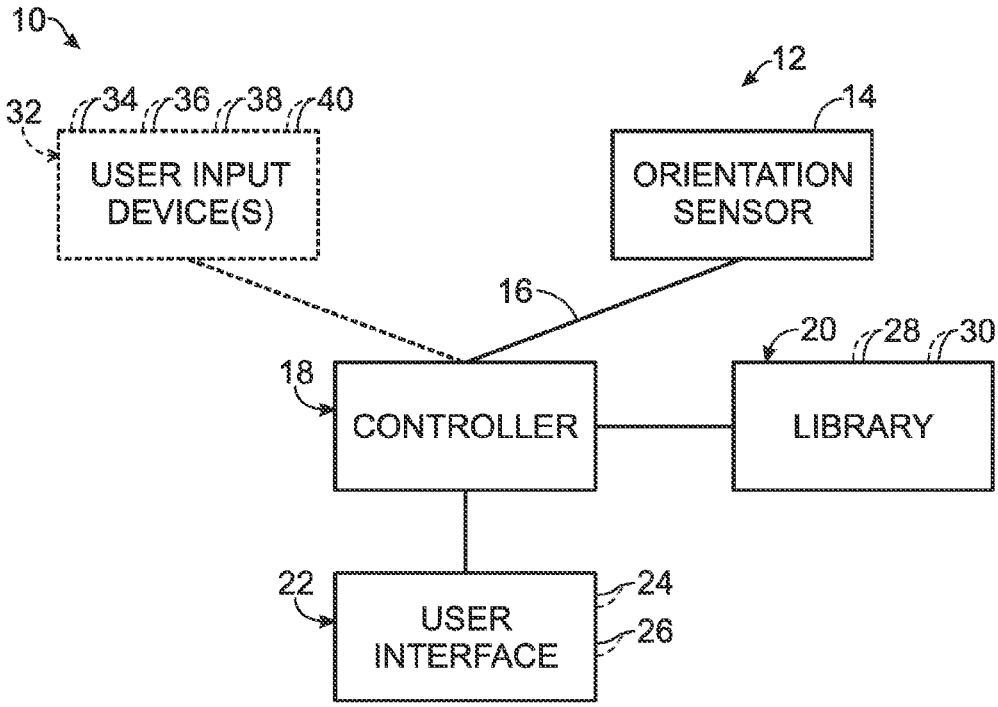
FIG. 1 is a schematic diagram of a toy having a sensor configured to detect the orientation of the toy and a controller configured to alter the toy output based on the detected orientation.

FIG. 1 is a schematic diagram of a toy 10 that is configured to detect the orientation of the toy and produce an output in response to the detected orientation. Toy 10 includes an orientation sensor 12 to detect the orientation of the toy. In some versions of the toy, the sensor may be configured to detect the toy being moved through a series of orientations in a predetermined amount of time. The sensor may be configured to detect at least a first orientation of the toy and a second orientation of the toy, but may be configured to detect numerous orientations of the toy depending on the shape of the toy.

The sensor may be mounted in any suitable location on the interior or exterior of the toy and may include one or more electric switches, such as a gravity switch 14 or other suitable sensor, to provide a sensor output 16 that may be used to control the output produced by the toy. Switch 14 may be configured to detect a variety of orientations and/or changes in orientation of the toy without the need for external buttons or other sensors. For example, a movable electrically conductive member may be urged by gravity to contact one or more of a plurality of electrical connectors, thereby enabling a signal to pass between them to determine the orientation of the toy. Consequently, the device need not be set on a support surface to activate the switch and alter the play features. Examples of sensors that determine the orientation of toys are disclosed in U.S. Patent Application Publication Nos. 2006/0154711 and 2006/0172787. In some versions, the sensor may be triggered when the orientation of the toy is approximately level, such as thirty degrees from horizontal, so that a user may hold the toy in his or her hands rather than having to set the toy on a perfectly level surface.

Toy 10 includes a controller 18 which uses the sensor output 16 from the orientation sensor to select a toy output, or set of outputs, from a library of toy outputs 20. The controller may select the toy output in response to the sensor output or in response to the sensor output and additional factors such as the amount of time a child has played with the toy. In some versions, when the device is in a first orientation, a first output from the library may be selected. When the device is rotated to a second orientation, the sensor output may communicate with the controller and trigger the device to select a second output along with suitable changes in other game features and accessories. The controller may be configured to select a particular toy output, such as a response to detection of a particular orientation, or the controller may select toy outputs in a random fashion. The controller may be configured to select a particular set of toy outputs in response to detection of a particular series of orientations of the toy. Controller 18 generally includes any portion of toy 10 configured or adapted to receive sensor output 16 and select one or more outputs from the library and communicate such outputs to a user.

Controller 18 communicates the selected toy output(s) to a user via user interface 22. The user interface may include one or more displays 24 to visually display the toy outputs, one or more speakers 26 to provide audio outputs to a user, and/or any other components necessary to provide an output to a user, such as tactile or olfactory changes to the toy. The controller may include a processor and associated programming that processes inputs from sensor 12 and outputs visual animation through display 24, audio feedback through speaker 26, and/or impart motion to one or more components of the toy.

The toy may be configured to provide a variety of characters and games. Consequently, the library of toy outputs 20 may include a variety of toy features, such as one or more personas 28 and/or one or more play modes 30, as will subsequently be described. The controller may therefore select a set of toy outputs including at least one of a persona and a play mode. The toy may allow a user to select a desired persona and/or play mode by placing the toy in a particular orientation or moving the toy through a particular series of orientations. In some versions of the toy, changes in the orientation of the toy may trigger random selection of a persona and/or play mode. In other versions, one or more orientations may correspond to a particular toy feature. For example, when the device is in a first orientation, a first particular persona may be provided. When the device is rotated to a second orientation, the sensor output may communicate with the controller and trigger the device to provide a second particular persona, along with suitable changes in other game features and accessories. For example, when the toy is in a first orientation, the displayed persona may be a pet-like persona, whereas in a second orientation the displayed persona may be a human-like persona.

In still other versions of the toy, various combinations of orientations may activate various combinations of personas and play modes. For example, a user may rotate the toy to a particular orientation to select a particular persona, manipulate a user input device, such as a button, to maintain that persona, and then rotate the toy to a different orientation to select a play mode in addition to the selected persona.

"Persona," as used herein, refers to the role or image that is displayed in a given environment. For example, a first persona may represent a character during the day, such as at an office job, while a second persona may represent the character during the night, such as at a party in which the "inner self" of the character is displayed to a user. The first persona may represent the character's public image, such as a traditional homemaker, while a second persona may represent the character's secret life, such as that of a government agent or spy. As another example, one persona may represent a character having good characteristics, whereas another persona may represent the character having bad or evil characteristics. For example, the character may turn into a burglar or other criminal, a vampire, a werewolf, or other monster, and the like, depending on the orientation and corresponding aspects of the toy. As yet another example, the available character personas may be altered between personas associated with political changes such as between war and peace, environmental changes such as a land animal to a water animal, and the like. Some changes in orientation may alter the persona between two completely different characters, such as a female character and a male character, such as to provide play options to a greater number of users.

"Play mode," as used herein, refers to the activities and/or game features that are available to a user while the toy is in a particular orientation. The play modes may include various levels of game play, such as intermediate or advanced, and/or various types of games, such as race games, fighting games, nurturing games, and the like. As another example, the play modes may include games or other programs to teach a user alphabets and vocabulary, numbers and mathematics, foreign languages, colors, geography, and the like.

Toy 10 may include one or more user input devices 32 to assist a user in interacting with the toy. A plurality of user input devices, such as one or more buttons 34, levers 36, dials 38, touch screens 40, and the like. The user input devices may assist a user in navigating the toy features, inputting information, such as the age of the user to select age-appropriate features, inputting responses, such as answers to trivia questions, and the like.

Figure 2:
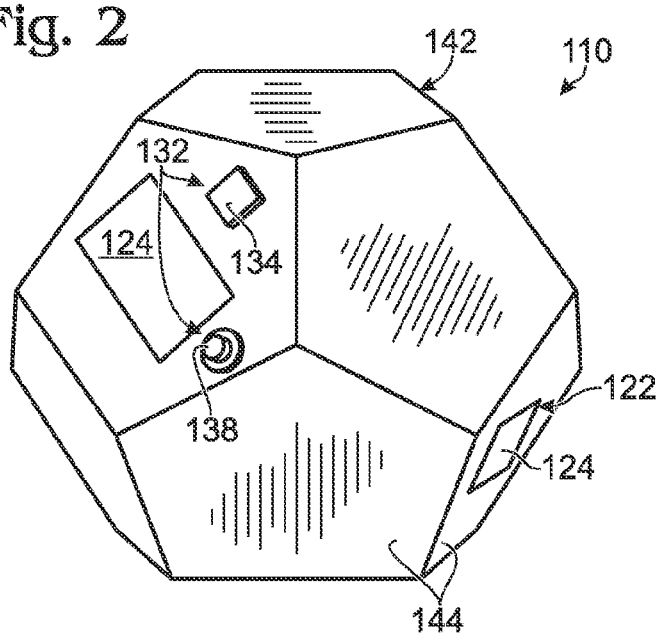
FIG. 2 is a perspective view of an exemplary toy in accordance with FIG. 1.

FIG. 2 illustrates an exemplary toy 110 includes a body 142 for housing the toy components, such as a sensor (not shown), a controller (not shown), a library of outputs (not shown), a user interface 122, and one or more user input devices 132. Consequently, the sensor may be configured to detect the orientation of the toy by detecting the orientation of the body.

As shown in FIG. 2, the body may include several sides or orientation surfaces 144. The toy may be set on a playing surface so that a particular side is visible to a user. The sensor may detect the orientation of the toy based on which side is touching the playing surface.

The exemplary toy of FIG. 2 includes a display 24 to communicate to a user the persona and/or play mode that is currently active. The toy may include a single display, a display on a few of the sides, or a display on each side. The display may be of any suitable size, type, and resolution. For example the display may be a liquid crystal display (LCD), such as in the form of a transparent screen. In such a configuration, additional features of toy 110 may be positioned behind the display yet still be visible to a user, either all of the time or only some of the time, such as when the display is activated and/or lighted. Toy 110 may include a variety of user input devices 132, including, but not limited to, a button 134 and a dial 138.

Figure 3:
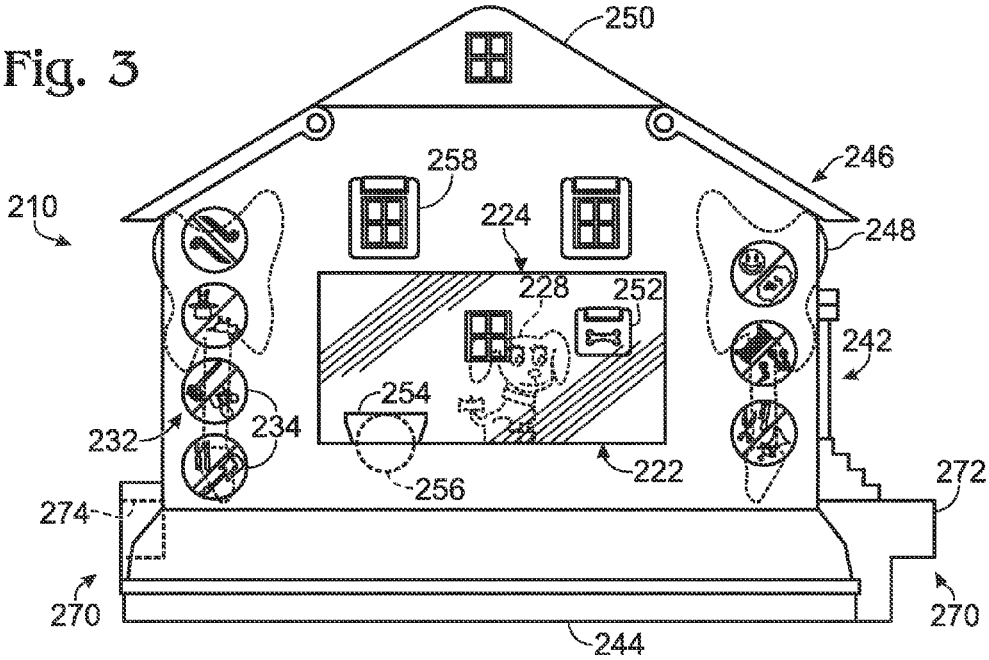
FIG. 3 is a front view of an exemplary toy in a first orientation.
Figure 4:
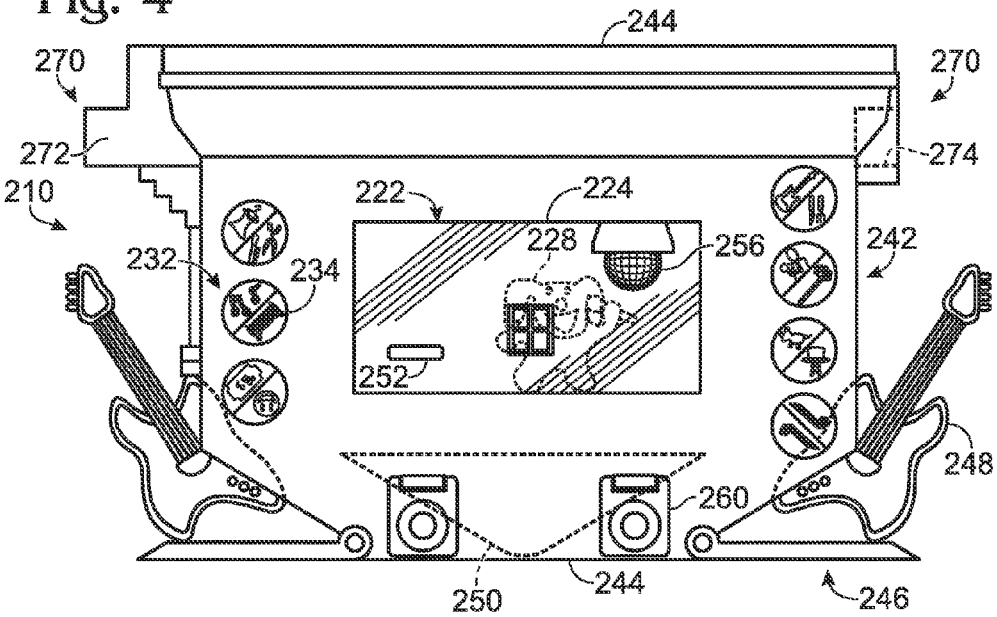
FIG. 4 is a front view of the exemplary toy of FIG. 3 in a second orientation.

FIGS. 3 and 4 depict another exemplary toy. As shown, toy 210 includes movable body portions 246. The movable body portions may be located in front of a display 222, in back of the display (i.e., positioned on the interior of the toy), or may be mounted to the exterior of a body 242 so that the movable portion appears and disappears as the body is flipped over, and then flipped over again, as demonstrated in FIGS. 3 and 4. The toy may therefore include a two-dimensional representation of a persona 228 and/or play mode on an LCD screen that interacts with three-dimensional movable portions.

Additional aspects of the toy may change to bring the environment of the toy into correspondence with the persona and/or play mode. For example, the toy may include movable body portions 246 coupled to the body and configured to move in response to changes in the orientation of the body. The movable portions may be configured to move in response to the sensor output. For example, the toy may include a motor or mechanism that alters the position or orientation of a movable portion in response to a sensor output indicating a change in orientation. In some versions of the toy, at least one of the movable portions is configured to move from a first position or orientation, in which the movable portion is substantially hidden, to a second position or orientation, in which the movable portion is substantially visible. For example, a movable portion may be coupled to a back side of the body or the interior of the body and extend away from the body as the orientation of the body is altered. The orientation sensor may be coupled to one of the movable portion, such as when the movable portion is configured to move in response to gravity.

As shown in the exemplary toy of FIGS. 3 and 4, the toy may be altered from a pet-theme, such as a pet dog, in a first orientation to a teen or disco theme in a second orientation. Sections of a roof may rotate to become floor sections that include features related to the persona, such as guitars 248 for a rock star persona. Other sections of the roof 250 may compress into the body, such as to move from an extended position, as shown in FIG. 3, to a recessed position, as shown in FIG. 4. Other movable body portions may be positioned in front of or behind display 224. For example, a painting 252 of a dog bone may rotate to extend from the wall and form a table. A dog dish 254, as shown in FIG. 3, may include a disco ball 256 that extends to a visible position when the toy is upside-down, as shown in FIG. 4. Some of the windows 258 may rotate to represent speakers 260. The movable body portions may be configured to rotate, translate, open or close, extend or retract, and the like. The movable body portions may move in response to gravity, such as by having a weighted portion, and/or may be moved by motors or mechanical components.

Figure 5:
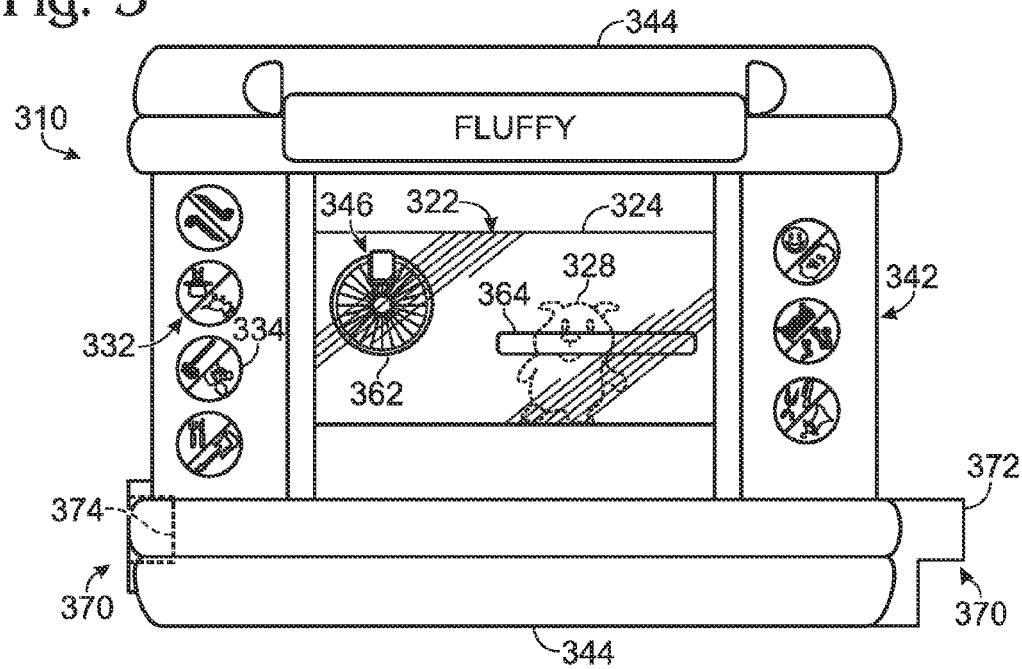
FIG. 5 is a front view of another exemplary toy in a first orientation.
Figure 6:
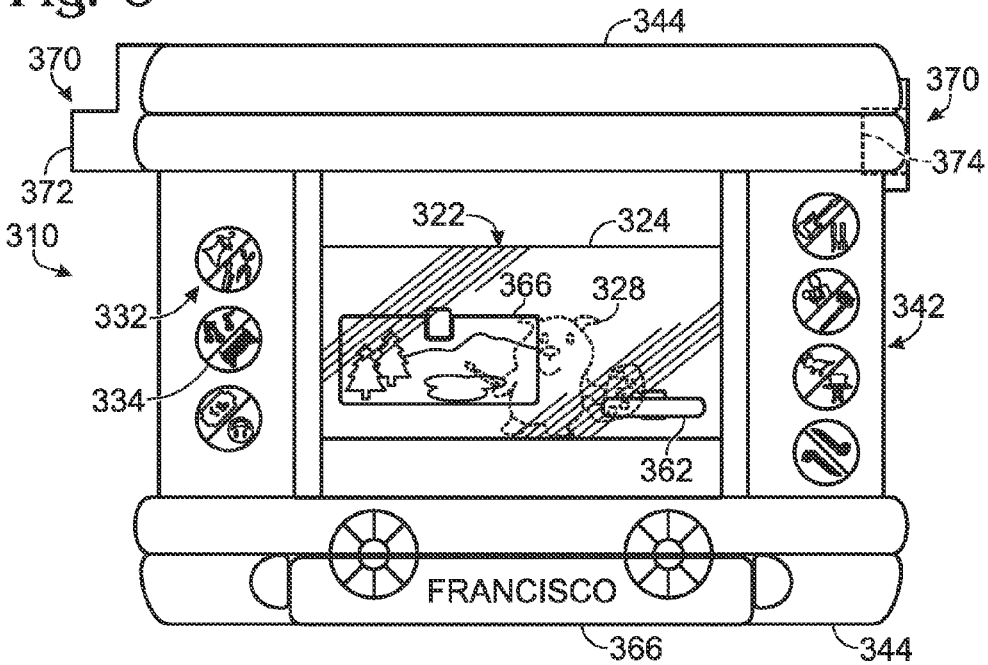
FIG. 6 is a front view of the exemplary toy of FIG. 5 in a second orientation.

FIGS. 5 and 6 depict another exemplary toy 310. As shown, the toy includes a display 324 and a variety of user input devices 332 in the form of buttons 334 to assist a user in interacting with the toy. The toy may be alterable between a first persona which represents a pet hamster to a second persona which represents the secret life of the hamster, such as an artist. Toy 310 may include movable body portions 346, such as to alter the toy between a pet-theme in a first orientation and an artist theme in a second orientation. For example, a hamster wheel 362 may rotate to extend from the wall and form a table. A rotatable component configured to represent a bed 364, as shown in FIG. 5, may rotate to become a canvas 366 when the toy is upside-down, as shown in FIG. 6. The toy may include exterior portions with positions that may be altered when the orientation of the toy is altered. For example, a name plate 368 may display a name of the pet in a first orientation, as shown in FIG. 5, and a different name for the artist persona, as shown in FIG. 6, such as with stylized font and decorations related to the artist, such as color wheels. The personas 328 may be displayed graphically using a liquid crystal display.

The exemplary toys of FIGS. 3-6 illustrate toys having two personas, a first persona for when the toy is right-side-up and a second persona for when the toy is upside-down. The exemplary personas are that of a normal pet and that of the secret life of the pet, such as when the owner is not watching. While the normal persona is active, the user can feed and nurture the pet and watch it engage in typical pet behaviors, such as play with a ball or a hamster wheel. However, once the housing is rotated, the secret persona may become active and the interior may transform to reveal the secret life of the pet, such as a disco star singing into a microphone or an artist using a paint brush and palette. For example, the user can teach the pet new dance moves, help the pet practice playing an instrument, control the pet's concert performance, help the pet learn to paint, and the like.

The user input devices may assist a user in navigating through the toy features, such as caring for a persona or playing a game. In the examples shown in FIGS. 3-6, the toy includes seven user input devices in the form of buttons 234, 334 to nurture and play with a persona in the form of a pet. The buttons may be imprinted with indicia, may be shaped or colored differently from one another, or otherwise distinguishable. For example, a "Yes" button may include indicia in the form of a checkmark and makes a selection the user desires. A "Clean Up/Photo" button may be pressed to make sure the pet's home isn't a mess when the pet's normal persona is active, but while the secret persona is active the button may be used to take a snap shot of the persona, such as of a celebrity pet. A "Bed Time/Sing" button may be selected to make the pet go to sleep while the normal persona is active, but may be used to teach the pet how to harmonize with it's different songs while the secret persona is active. A "Food/Instrument" button may initiate feeding of the pet while the normal persona is active, or may teach the pet how to use its different instruments while the secret persona is active. A "Groom/Fashion" button may groom the pet daily to make sure it stays happy and healthy while the normal persona is active, or may put the pet in different fashions while the secret persona is active. A "Tricks/Dance" button may teach the pet a variety of tricks while the normal persona is active, or may help the pet learn new dance moves to go along with its musical talent while the secret persona is active. A "Games/Perform" button may select different games for a user and the pet to play while the normal persona is active, but while the secret persona is active may produce a concert to show the previously acquired skills. The more a persona is nurtured (i.e. played with) the more benefits the persona may obtain, such as in the form of more food, clothes, songs and games. Conversely, if a toy is not played with for a predetermined time, some of the toy features may not be accessible to a user until the user has resumed playing with the toy, such as by reaching a specific level or by playing with the toy for a specific amount of time.

As previously described, the toy may display various personas in the form of characters and may alter various body portions to correspond the environment to the persona (and/or a play mode). As such, the toy may provide an animated, interactive dollhouse. The animated characters that represent the personas, or that may be used in the variety of play modes, may include changes in facial and body expressions and/or changes in voice.

As shown in FIGS. 3-6, the toy may include one or more communication assemblies 270, 370 to enable the toy to communicate with other toys and/or accessories. The toy may communicate through wireless or physical connectors. Any suitable connectors and/or electronics may be used and positioned in any suitable location of the toy. In the exemplary toys of FIGS. 3-6, the communication assembly includes a plug 272, 372 on one side of the body and a socket 274, 374 on the other side of the body. A user may therefore couple two or more toys together so that the personas and/or play modes are shared between the toys. For example, when two or more toys are coupled together, the active personas may visit one another, trade places, or otherwise interact with the other toy.

The toy may include various lights, such as light emitting diodes (LEDs) that light up portions of the interior of the body so that various features, such as the movable body portions are visible, such as through the display. The LEDs may flash or be of various colors to enhance the play features of the toy, such as to mimic the lights of parties or concerts.

The toy may be fabricated from any suitable material, or combination of materials, such as plastic, foamed plastic, wood, cardboard, pressed paper, metal, or the like. A suitable material may be selected to provide a desirable combination of weight, strength, durability, cost, manufacturability, appearance, safety, ergonomics, and the like. Suitable plastics may include high-density polyethylene (HDPE), low-density polyethylene (LDPE), polystyrene, acrylonitrile butadiene styrene (ABS), polycarbonate, polyethylene terephthalate (PET), polypropylene, ethylene-vinyl acetate (EVA), or the like. Suitable foamed plastics may include expanded or extruded polystyrene, expanded or extruded polypropylene, EVA foam, or the like.

Although the present invention has been shown and described with reference to the foregoing operational principles and preferred embodiments, it will be apparent to those skilled in the art that various changes in form and detail can be made without departing from the spirit and scope of the invention. The present invention is intended to embrace all such alternatives, modifications and variances falling within the scope of the appended claims. Inventions embodied in various combinations and subcombinations of features, functions, elements, and/or properties may be claimed through presentation of claims in a subsequent application.

What is claimed is:

1. An electronic toy comprising:

a body having first and second orientation surfaces facing different directions, the body being configured to house a plurality of components including:

a sensor mounted to the body and adapted to detect at least a first orientation of the body when the first orientation surface is above the second orientation surface and a second orientation of the body when the body is rotated so that the second orientation surface is above the first orientation surface, and provide a corresponding sensor output;

a controller configured to receive the sensor output and select a corresponding set of toy outputs from a library of toy outputs, where the selected set of toy outputs including at least one of a play mode and a persona; and one or more movable portions coupled to the body and adapted to move relative to the body in response to changes in the orientation of the body so that the one or more movable portions are hidden in one of the first and second orientations and at least partially visible when the body is in the other of the first and second orientations.

2. The toy of claim 1, wherein the one or more movable portions are mounted to an exterior of the body.

3. The toy of claim 1, wherein the one or more movable portions are adapted to move in response to the sensor output.

4. The toy of claim 1, wherein at least one of the movable portions is configured to move from a first position, in which the movable portion is substantially hidden, to a second position, in which the movable portion is substantially visible.

5. The toy of claim 1, wherein the sensor is coupled to one of the movable portions and the movable portion is adapted to move in response to gravity, thereby triggering the sensor.

6. The toy of claim 1, wherein the sensor is located on the interior of the body and includes a gravity switch.

7. The toy of claim 1, wherein the controller is configured to select a particular persona in response to detection of a particular orientation of the body.

8. The toy of claim 1, wherein the controller is configured to select a particular set of toy outputs in response to detection of a particular series of orientations of the body.

9. A method of accessing features of a toy having a body including first and second orientation surfaces facing different directions, the body being configured to house a plurality of components including a sensor adapted to detect at least a first and a second orientation of the body and provide a corresponding sensor output, and a controller configured to access one of a first persona and a second persona from a library of toy outputs in response to the sensor output, the method comprising:

detecting a first orientation of the body when the first orientation surface is above the second orientation surface and a second orientation of the body when the body is rotated so that the second orientation surface is above the first orientation surface;

selecting a persona from the library in response to the detected orientation of the body;

communicating the selected toy output to a user interface; and altering, in response to the detected orientation of the body, a movable portion of the body relative to the body from a first position to a second position so that the movable portion is hidden in one of the first and second orientations and at least partially visible when the body is in the other of the first and second orientations.

10. The method of claim 9, further comprising selecting a play mode from the library of toy outputs.

11. The method of claim 9, wherein the movable portion is mounted on an exterior of the body.

12. The method of claim 9, further comprising detecting a series of orientations of the body and selecting a persona in response to the detected series of orientation.

13. The method of claim 9, wherein a particular persona is selected in response to detection of a particular orientation.

14. The method of claim 9, wherein the step of communicating the selected toy output includes lighting a display.

15. An electronic toy having a body including first and second orientation surfaces facing different directions, comprising:

a means, mounted to the body of the toy, for sensing at least a first orientation of the body when the first orientation surface is above the second orientation surface and a second orientation of the body when the body is rotated so that the second orientation surface is above the first orientation surface;

a means for selecting a persona from a library of personas in response to the sensed orientation;

a means for displaying the selected persona; and a housing including one or more movable portions configured to move relative to the housing in response to movement of the housing so that the movable portion is hidden in one of the first and second orientations and at least partially visible in the other of the first and second orientations.

16. The toy of claim 15, wherein the means for displaying the selected persona includes a liquid crystal display.

17. The toy of claim 16, wherein the liquid crystal display is disposed within the housing and at least one of the movable portions is disposed within the housing such that the at least one movable portion becomes visible when the liquid crystal display is lighted.

18. The toy of claim 15, wherein at least one of the movable portions is configured to move relative to the housing from a first position, in which the movable portion is substantially hidden, to a second position, in which the movable portion is substantially visible.

19. The toy of claim 18, wherein the at least one movable portion is configured to recess within the housing in the first position.

20. The toy of claim 16 wherein at least one of the one or more movable portions is mounted within the housing so that it is at least partially visible through the liquid crystal display in one of the first and second orientations.

21. The toy of claim 1, wherein the one or more movable portions are mounted to an interior of the body.

* * * * *